US008443791B2

(12) United States Patent
Miller

(10) Patent No.: US 8,443,791 B2
(45) **Date of Patent: *May 21, 2013**

(54) DUAL FEED-OUT ARCHERY CAM

(75) Inventor: Larry D. Miller, Rochester, MI (US)

(73) Assignee: MCP IP, LLC, Sparta, WI (US)

( * ) Notice: Subject to any disclaimer, the term of this patent is extended or adjusted under 35 U.S.C. 154(b) by 79 days.

This patent is subject to a terminal disclaimer.

(21) Appl. No.: 12/820,405

(22) Filed: Jun. 22, 2010

(65) Prior Publication Data

US 2010/0252013 A1 Oct. 7, 2010

Related U.S. Application Data

(63) Continuation-in-part of application No. 12/110,447, filed on Apr. 28, 2008, now Pat. No. 7,946,281.

(60) Provisional application No. 60/946,495, filed on Jun. 27, 2007, provisional application No. 61/219,567, filed on Jun. 23, 2009.

(51) Int. Cl.
*F41B 5/10* (2006.01)

(52) U.S. Cl.
USPC ..... 124/25.6

(58) Field of Classification Search ..... 124/25.6, 124/900
See application file for complete search history.

(56) References Cited

U.S. PATENT DOCUMENTS

| | | | | |
|---|---|---|---|---|
| 3,486,495 | A * | 12/1969 | Allen | 124/25.6 |
| 5,505,185 | A * | 4/1996 | Miller | 124/25.6 |
| 6,247,466 | B1 * | 6/2001 | McPherson | 124/25.6 |
| 6,321,736 | B1 * | 11/2001 | McPherson | 124/25.6 |
| 6,443,139 | B1 * | 9/2002 | McPherson | 124/25.6 |
| 6,688,295 | B1 * | 2/2004 | Miller | 124/25.6 |
| 6,990,970 | B1 * | 1/2006 | Darlington | 124/25.6 |
| 7,946,281 | B2 * | 5/2011 | Miller | 124/25.6 |

* cited by examiner

*Primary Examiner* — John Ricci
(74) *Attorney, Agent, or Firm* — Vidas, Arrett & Steinkraus

(57) ABSTRACT

An archery bow includes a cam assembly rotatably supported at a pivot axis on a limb of the bow. The cam assembly includes a primary string feed-out which operates to feed out a length of a bowstring as the bow is drawn. The cam assembly includes a control system associated with a secondary string feed-out. The control system is operative, during the time the bow is being drawn and the primary string is being fed out, to control the effective length of a secondary portion of the string such that during an initial portion of the draw of the bow, the effective length of that secondary portion decreases and so that during a subsequent portion of the draw, the effective length increases. The controller thereby operates to modify the force draw profile of the bow so as to increase the amount of energy stored therein during the initial portion of the draw.

14 Claims, 8 Drawing Sheets

FIG. 2
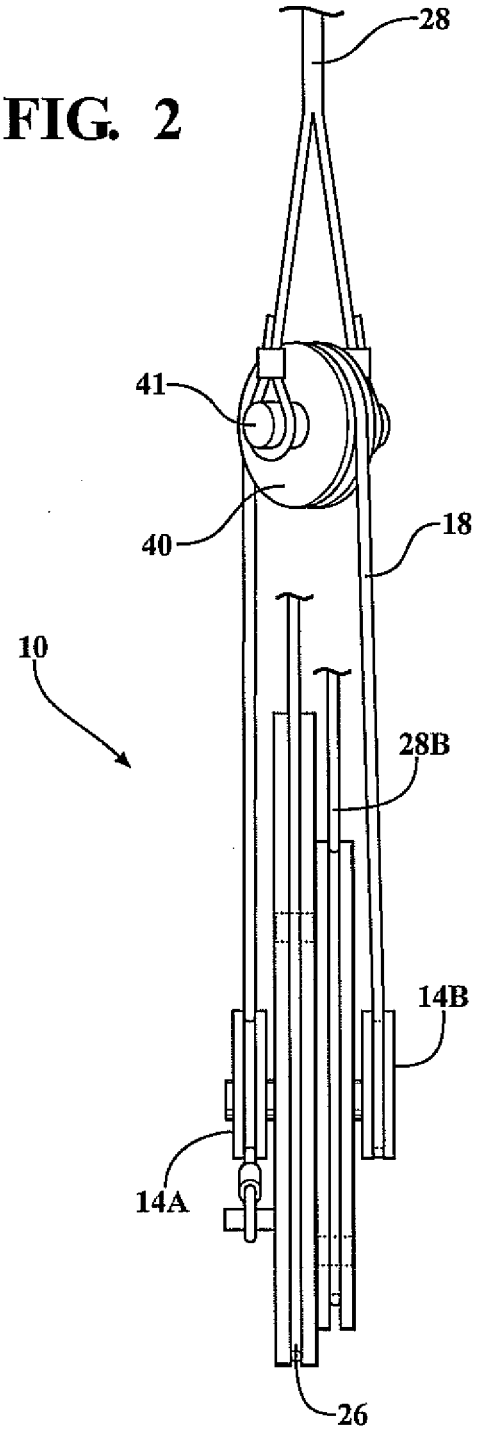
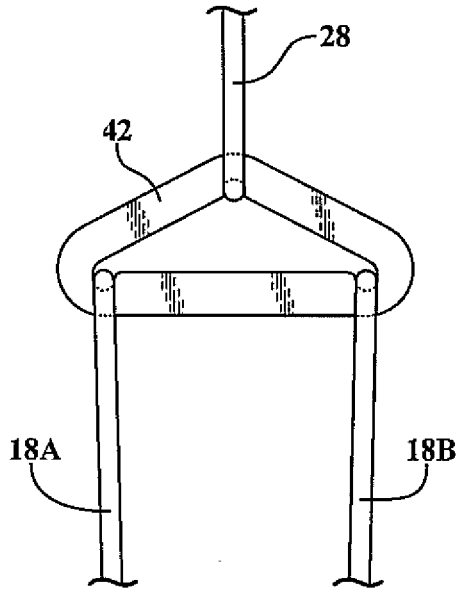
FIG. 3
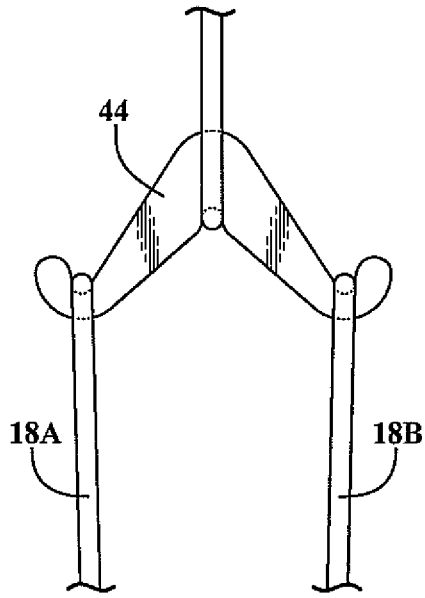
FIG. 4

DUAL FEED-OUT ARCHERY CAM

RELATED APPLICATION

This application claims priority of U.S. Provisional Patent Application Ser. No. 61/219,567 filed Jun. 23, 2009, entitled "Dual Feed-Out Archery Cam", which is incorporated herein by reference. This application is also a continuation in part of U.S. patent application Ser. No. 12/110,447 filed Apr. 28, 2008, entitled "Balanced Pulley Assembly For Compound Archery Bows, And Bows Incorporating That Assembly," which in turn claims priority of U.S. Provisional Patent Application Ser. No. 60/946,495 filed Jun. 27, 2007, both of which are incorporated herein by reference.

FIELD OF THE INVENTION

This invention relates generally to archery. More specifically, the invention relates to compound archery bows; and specifically, the invention relates to a cam assembly for use in compound archery bows wherein said cam assembly is operative to vary the tension on the bowstring during the draw cycle of the bow so as to provide for an inherently balanced draw and/or optimize the force draw profile of the bow.

BACKGROUND OF THE INVENTION

A compound archery bow includes a bowstring operative in conjunction with one or two particularly configured cam assemblies (also referred to as pulleys), which serve to transfer energy between the resilient limbs of the bow and a bowstring so as to control the force/draw profile of the bow. In the operation of a typical compound bow, portions of the length of the bowstring are wound into and let out of various grooves in the cam assembly thereby varying the effective length of the bowstring and influencing the force/draw profile of the bow, which is understood to be the force which is required to displace the nock point of the bowstring over a particular distance. It is to be understood that in some instances, a compound bow will include a single, continuous bowstring which wraps around and extends between pulleys or cams associated with both of the bow limbs; while in other instances, a compound bow will include a bowstring comprised of several separate segments which may be variously affixed to different portions of the bow and cam assemblies. In all instances, such continuous or segmented strings are referred to herein as the bowstring or simply the string.

As will be explained in detail hereinbelow, the present invention is directed to a specific design of archery bow cam assembly which is referred to as a dual feed-out cam. In it, a primary string feed-out is operative to feed out a length of bowstring as the bow is drawn. A secondary string feed-out controls the feed out of another portion of the bowstring (either a continuous portion or a discrete portion as described above) during the time the primary portion of the bowstring is being drawn. In a two cam bow system, the fed out portion of string from the secondary feed is typically taken up by a take-up groove on a paired cam. The portion of the cam which takes up the string fed by the secondary feed-out is typically referred to as the "power cam" or power portion of the cam. When the cam assembly of the present invention is incorporated into a single cam bow system, the fed out string goes to an idler wheel and/or to the axle supporting the idler wheel on the opposite limb.

Some dual feed-out cam systems of the prior art are disclosed in U.S. Pat. Nos. 6,247,466 and 6,990,970, and the cam system of the present invention has advantages over such prior art cam systems, insofar as the secondary feed-out operates to initially shorten, and then lengthen, the portion of string being fed out as the bowstring is being drawn. This results in a faster build up of force in the force draw curve which results in more energy being stored. In addition, operation in this shortened/lengthened mode helps to maintain synchronization of cam assemblies in the case of a dual cam bow system. The cam system of the present invention also has advantages with regard to weight and cost over prior art cam systems such as that shown in U.S. Pat. No. 6,247,466 insofar as it avoids the need for expensive, bulky, and failure-prone bearing assemblies. These and other advantages of the invention will be apparent from the drawings, discussion and description which follow.

BRIEF DESCRIPTION OF THE INVENTION

Disclosed is a cam assembly configured to be rotatably supported at a pivot axis on a limb of an archery bow. The cam assembly includes a primary string feed-out configured and operative to feed out a length of a string as the bow is drawn; and a secondary string feed-out which is configured and operative so that when the bow is drawn and the primary feed-out feeds out the length of the string, the secondary string feed-out, during an initial portion of the draw, takes up a portion of the effective length of the string and thereafter lets out a portion of the effective length of the string. In some embodiments, the secondary string feed-out includes a control cable which is coupled to the string and wherein the secondary string feed-out is configured and operative so that when the bow is drawn, the effective length of the control cable decreases during the initial portion of the draw and then increases whereby the secondary string feed-out initially takes up and then lets out a portion of the length of the string. In such embodiments, the secondary string feed-out may include a cable controller which is operative, when the bow is drawn, to simultaneously shorten a first portion of the length of the control cable at a first rate and lengthen a second portion of the length of the control cable at a second rate so that during the initial portion of the draw, the first rate is greater than the second rate and thereafter the second rate is greater than the first rate. The cable of an assembly of this type may be mechanically coupled to the string via a pulley assembly or a yoke.

In some embodiments, the controller may include at least one grooved spool, and in particular embodiments the controller will include two grooved spools wherein a first one of the grooved spools is in mechanical engagement with a first end of the cable and the second grooved spool is in mechanical engagement with the second end of the cable. In embodiments of this type, the spools may be circular or noncircular, and in particular instances the spool may be eccentrically mounted relative to the axis of rotation of the cam assembly. In other embodiments, the controller may include a post about which a portion of the string or cable is wrapped.

BRIEF DESCRIPTION OF THE DRAWINGS

FIG. 2 is a front view of the controller of FIGS. 1A and 1B;

FIG. 3 is a depiction of an embodiment of a yoke assembly which may be utilized to couple a control cable to a portion of a bowstring in particular embodiments of the present invention;

FIG. 4 is a depiction of another yoke assembly which may be utilized to couple a control cable to a portion of a bowstring in accord with the present invention;

DETAILED DESCRIPTION OF THE INVENTION

Figure 1A:
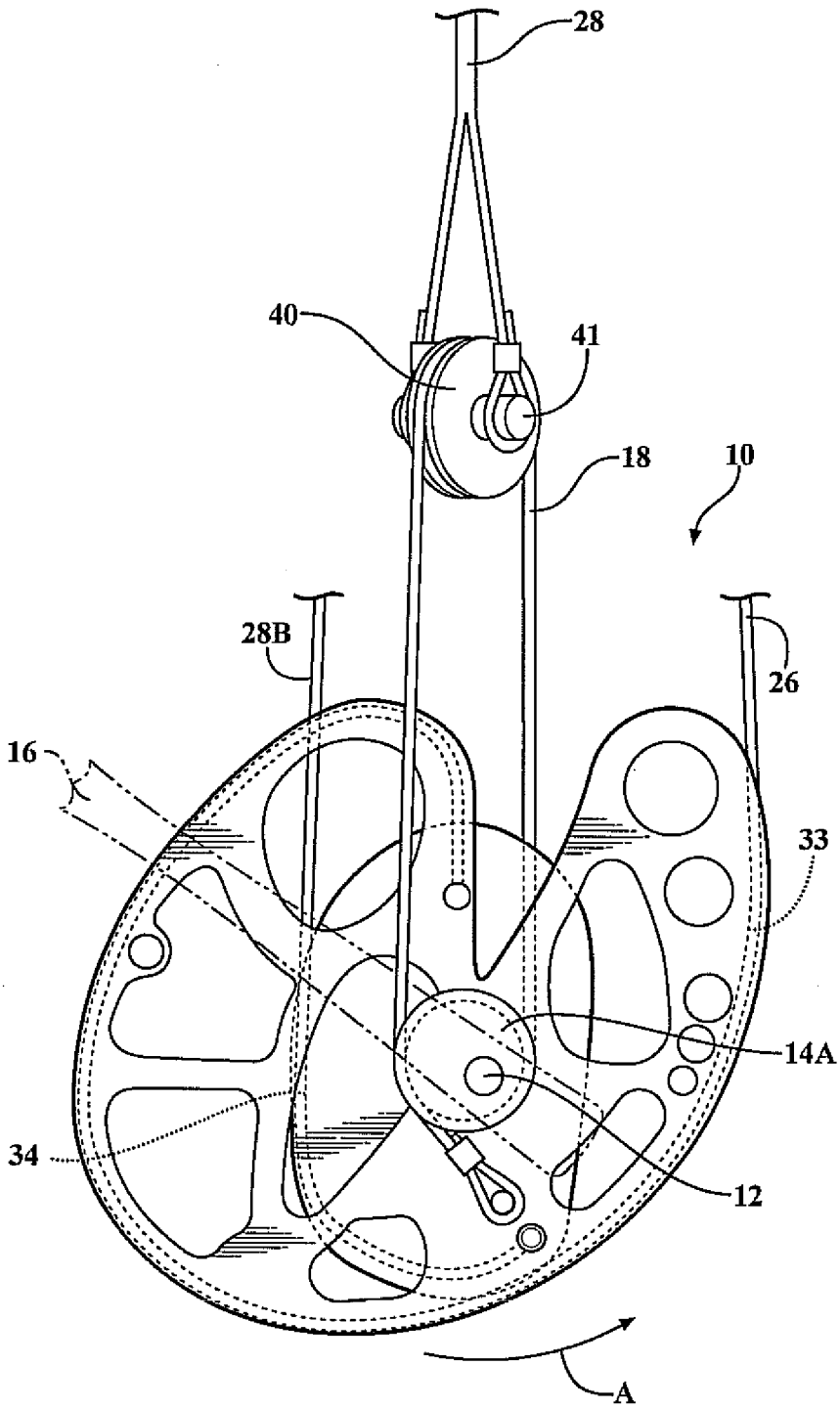
FIG. 1A is a first side view of a cam assembly in accord with the present invention.
Figure 1B:
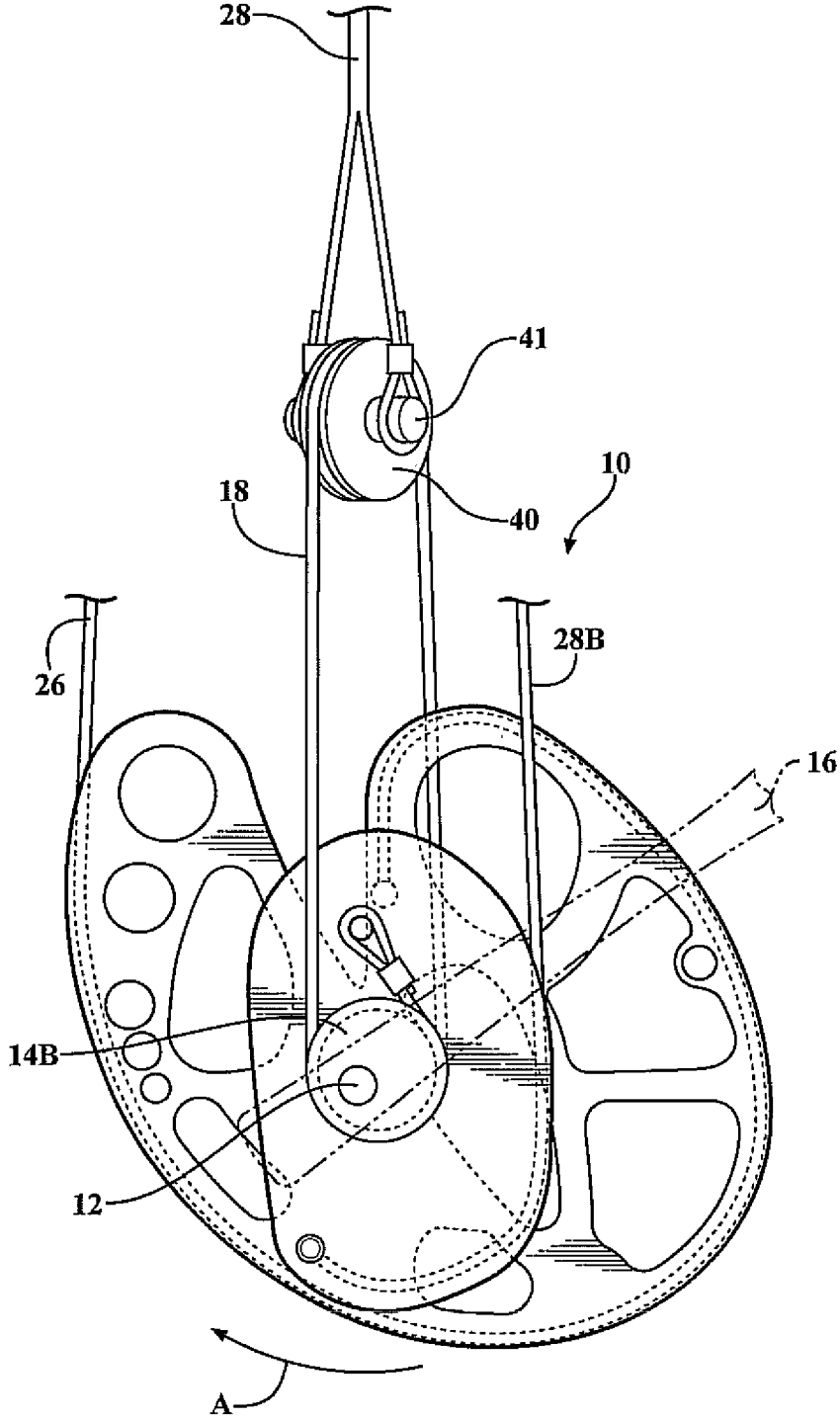
FIG. 1B is a second side view of the cam assembly of FIG. 1A.

Referring now to FIG. 1A, there is shown a first side view of a cam assembly 10 in accord with the present invention. The cam assembly 10 is pivotally supported upon a limb of an archery bow which is shown in phantom outline at reference numeral 16. In this regard, the cam assembly includes a cam axle 12 which pivotally supports the assembly. The cam assembly includes a primary string feed-out which is constituted by a groove 33 defined thereupon. A first portion 26 of a bowstring is retained in this groove and is fed out therefrom when the bow is drawn. In this regard, the drawing of the bow will cause the cam assembly 10 to rotate in the direction shown by arrow A. FIG. 1B is a second side view of the cam assembly 10 from the opposite face of that shown in FIG. 1A.

As detailed above, the cam assembly includes a secondary string feed-out which is configured and operative so that when the bow is drawn and the primary string feed-out feeds out a primary portion of string 26 therefrom, the secondary string feed-out initially takes up a length of a secondary portion 28 the string and thereafter lets out the length of the of the secondary portion 28 of the string. As is described in detail in the Ser. No. 12/110,447 parent patent application, the secondary portion of the string 28 is typically received by a take-up groove in a corresponding cam or pulley (not shown) which is disposed on an opposite limb of the bow. Such a take-up groove is shown in FIGS. 1A and 1B at reference numeral 34, and it functions to receive a secondary portion 28*b* of a string from such a corresponding cam or pulley.

In the FIGS. 1A and 1B illustrations, the function of taking up and letting out the string is accomplished by a controller, which in this instance is comprised of a pair of grooved spools 14*a*, 14*b*, as are best seen in FIG. 2 which is a front view of the controller 10 of FIGS. 1A and 1B. As will be seen from the figures, the spools in this instance are generally circular and are eccentrically mounted relative to the cam axle 12. Furthermore, the spools are affixed to the remainder of the cam so as to rotate in unison therewith when the bowstring is drawn. As will be seen from FIGS. 1A, 1B and 2, the controller spools 14 engage a control cable 18. In this regard, a first end of the control cable 18 is affixed to the cam assembly 10 in the region of the first spool 14*a*, and a second end of the cable is correspondingly affixed to the controller 10 in the region of the second spool 14*b*. As the cam assembly rotates in the direction of the arrow A, the first spool 14*a* takes up a portion of the length of the cable 18 thereby effectively shortening that length. Simultaneously, the second controller spool 14*b* lets out a portion of the length of the cable 18 thereby increasing its effective length. Given the shape and placement of the spools 14*a*, 14*b* and the affixation of the cable 18, the rate at which the first spool 14*a* shortens the cable 18 and the rate at which the second spool 14*b* lengthens the cable during the time bow is being drawn will differ. Specifically, during an initial portion of the draw, the cable 18 will shorten at a rate greater than that at which it lengthens, with the net result being that there is an overall shortening of the cable 18 during an initial portion of the draw. As will be seen from the drawings, further rotation of the cam assembly in the direction A as the bowstring approaches full draw will result in the rate of lengthening of the cable 18 to exceed the rate of its shortening, producing an overall lengthening of the cable.

As shown in FIGS. 1A, 1B and 2, the cable 18 is coupled to a portion of the bowstring 28 by a pulley assembly which includes a pulley 40, and an associated axle 41. The pulley 40 is rotatably mounted on the pulley axle 41, which in turn is coupled to a section 28 of the bowstring, which in this instance is bifurcated. As discussed above, this section 28 of the bowstring can run to a corresponding cam assembly associated with an opposite limb of the bow in a dual cam bow system. Alternatively, it can run to an idler pulley or opposite bow limb in a single-cam system. As shown in FIGS. 1A and 1B, a corresponding bowstring segment 28*b* can run from an upper cam assembly (not shown) in a two-cam system, and this segment 28*b* is then taken up in a groove 34 which is part of the power cam of the cam assembly 10. From the foregoing, it will be appreciated that when the bow is drawn by unwinding a segment of the bowstring 26 from the groove 33 defining the primary feed-out, the cam rotates in the direction A, and the control portion of the secondary string feed-out, which in this instance is comprised of the spools 14*a*, 14*b* and cable 18 operating in cooperation with the pulley 40, functions to initially take up a portion of the effective length of the string 28, and thereafter increase the effective length of the string 28. This action modifies the force draw profile enhancing the amount of energy which can be stored in the bow, smoothing the force draw curve, and improving the performance of the bow. Additionally, the take-up/let-out function of the control system also inherently stabilizes and balances the operation of a dual cam bow system by providing communication and feedback between the cams and limbs.

In the context of this disclosure, the cam assembly is described as operating to increase the effective length of the string during an initial portion of the draw, and lengthen the effective length of the string during a subsequent portion of the draw so as to modify the force draw profile of the bow. It is to be understood that reference to the initial portion of the draw during which the effective length of the string is taken up, and the portion thereafter during which the effective length is increased are relative terms meant to define the temporal sequence of the take-up and lengthening, and not meant to be limited to any particular portion of the draw of the string. However, in most instances, the initial portion of the draw will typically comprise at least part of the first half of the motion comprising the full draw of the bowstring, and in specific instances the initial take-up will occur during no more than one third of the full draw of the bowstring, while in certain particular instances the initial take-up will occur during the first quarter of the draw of the bowstring. It is also to be understood that between the time of the initial take-up of the effective length of the bowstring and the subsequent increase of the effective length of the string, there may be some period during which the effective length of the string remains constant. It is also to be understood that Applicant refers to the change in the string as being a change of the "effective" length of the string since the total length of the string will remain essentially constant, while the active length of the string extending from the pivot axis of the cam assembly of the present invention to the pivot axis of the other cam assembly, idler pulley, or such element disposed on the opposite limb of the bow will be increased or decreased accordingly.

In FIGS. 1A, 1B and 2, the bowstring segment 28 is shown as being coupled to the control cable 18 by means of a pulley 40 and axle 41. In alternative embodiments, such coupling may be accomplished by other mechanical means which will be apparent to those of skill in the art. As shown in FIG. 3, a triangular yoke 42 serves to couple the string 28 to a control cable, which in this instance is a two-part cable comprised of segment 18*a* and segment 18*b*. A similar arrangement is shown in FIG. 4 wherein a different design of yoke 44 accomplishes the same function. Yet other coupling arrangements may be employed.

Figure 5:
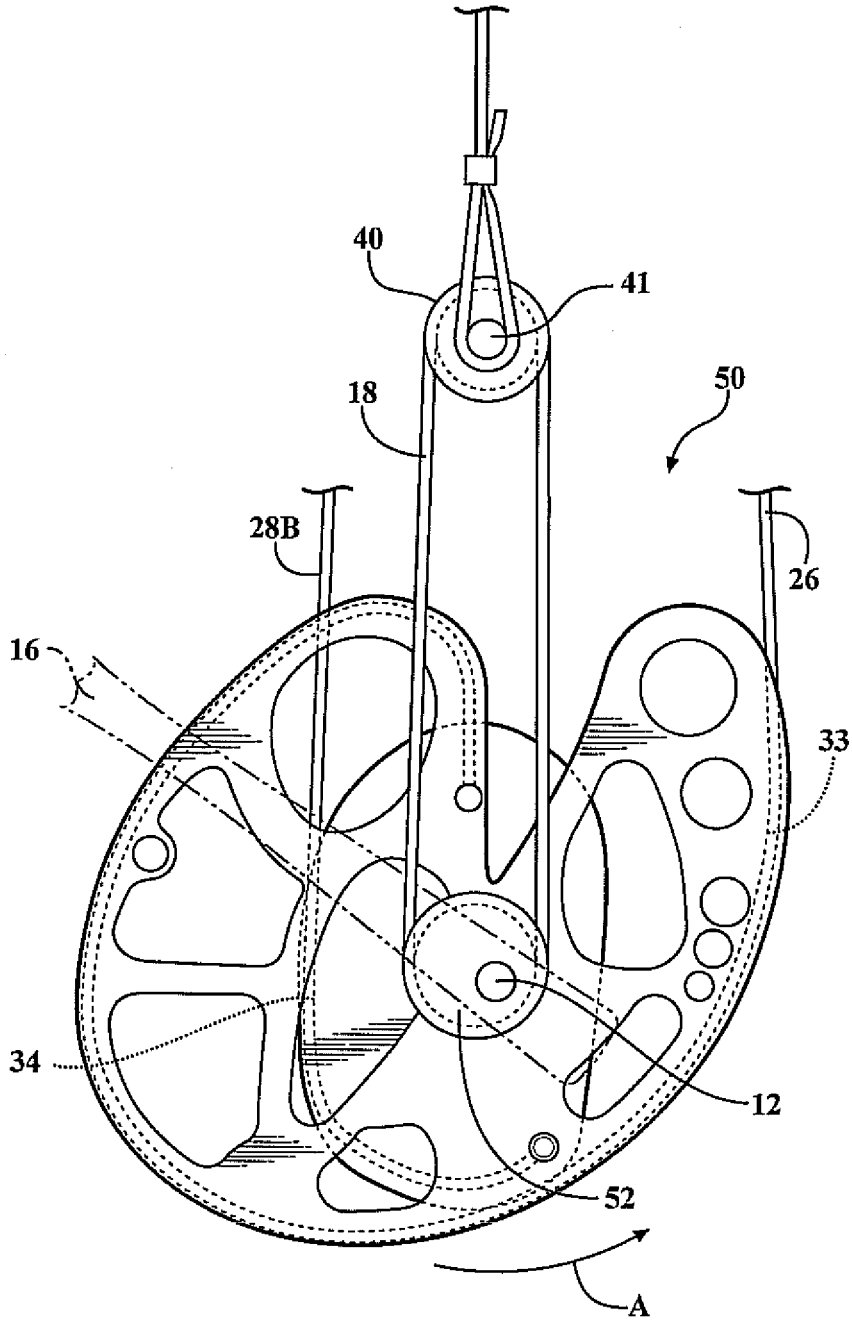
FIG. 5 is a view of a face of another cam assembly which may be implemented in accord with the present invention.
Figure 6:
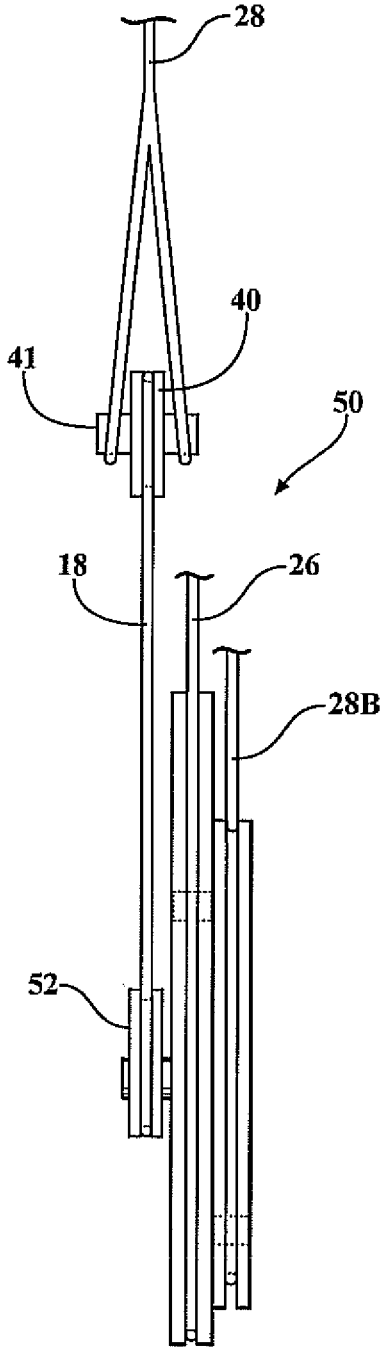
FIG. 6 is a front view of the cam assembly of FIG. 5.

Other embodiments of cam assembly may be implemented in accord with the present invention. Referring now to FIG. 5, there is shown a side view showing a first face of another version of cam assembly 50. In this assembly 50, as in the previous embodiment, a primary feed-out is constituted by a groove 33 which functions to feed out a bowstring 26 when the bow is drawn. The FIG. 5 embodiment includes a control system which is constituted by a single, grooved, spool member 52 which is eccentrically mounted with relation to the axle 12. In this embodiment, a control cable 18 is disposed so that both of its ends are affixed to the single spool 52, and given the eccentric mounting of the spool, it will be understood that as the earn rotates the two ends of the control cable will be taken up and released at different rates thereby accomplishing the same effective lengthening and shortening of the cable 18 as in the FIG. 1 embodiment. (Alternatively, in a variant of this embodiment the cable 18 may comprise a continuous loop which is affixed to the spool 52 at one or more points.) As in the previous embodiment, a pulley 40, and associated axle 41 couple the control cable 18 to a portion of a bowstring which is not shown in FIG. 5. FIG. 6 is an end view of the assembly of FIG. 5 and further illustrates the string 28 being affixed to the axle 41, which in turn rotatably supports the pulley 40.

Figure 7:
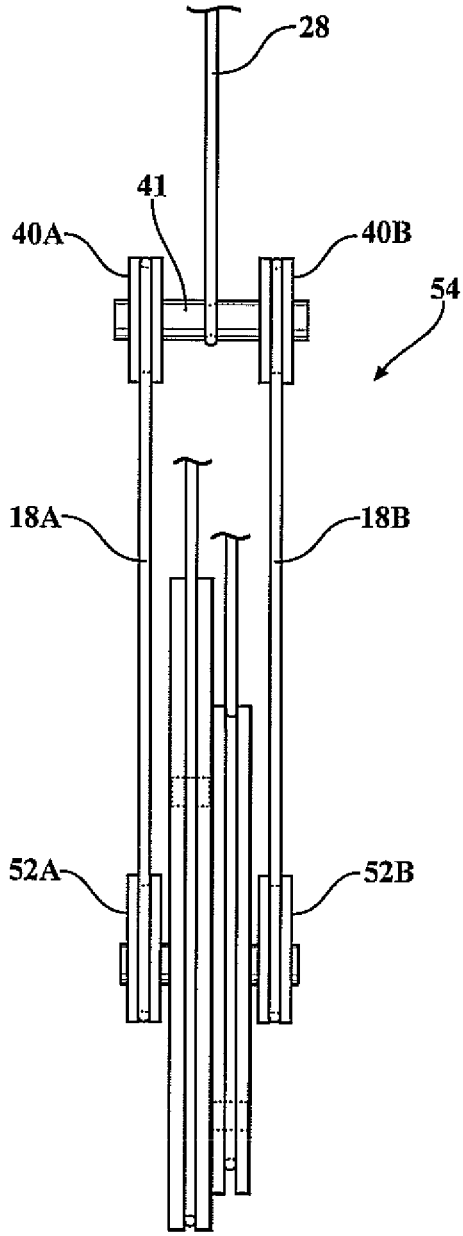
FIG. 7 is a front view of another embodiment of cam assembly of the present invention.

FIG. 7 shows yet another embodiment of cam assembly 54 which is generally similar to the embodiment 50 shown in FIGS. 5 and 6. The cam assembly 54 of the FIG. 7 embodiment includes two generally identical spool/cable controller assemblies of the type shown in FIG. 5. In this regard, the FIG. 7 embodiment shows a first spool 52*a* having a first cable 18*a* associated therewith, and a second spool 52*b* having a second cable 18*b* associated therewith. The cables 18*a*, 18*b* are each coupled to a respective pulley 40*a*, 40*b*, which pulleys are in turn connected to a single pulley axle 41, which is connected to the string segment 28 as previously described. One advantage of this particular arrangement is that loading of the cam-supporting axle 12 is symmetric thereby enhancing the durability and performance of the cam assembly.

Figure 8:
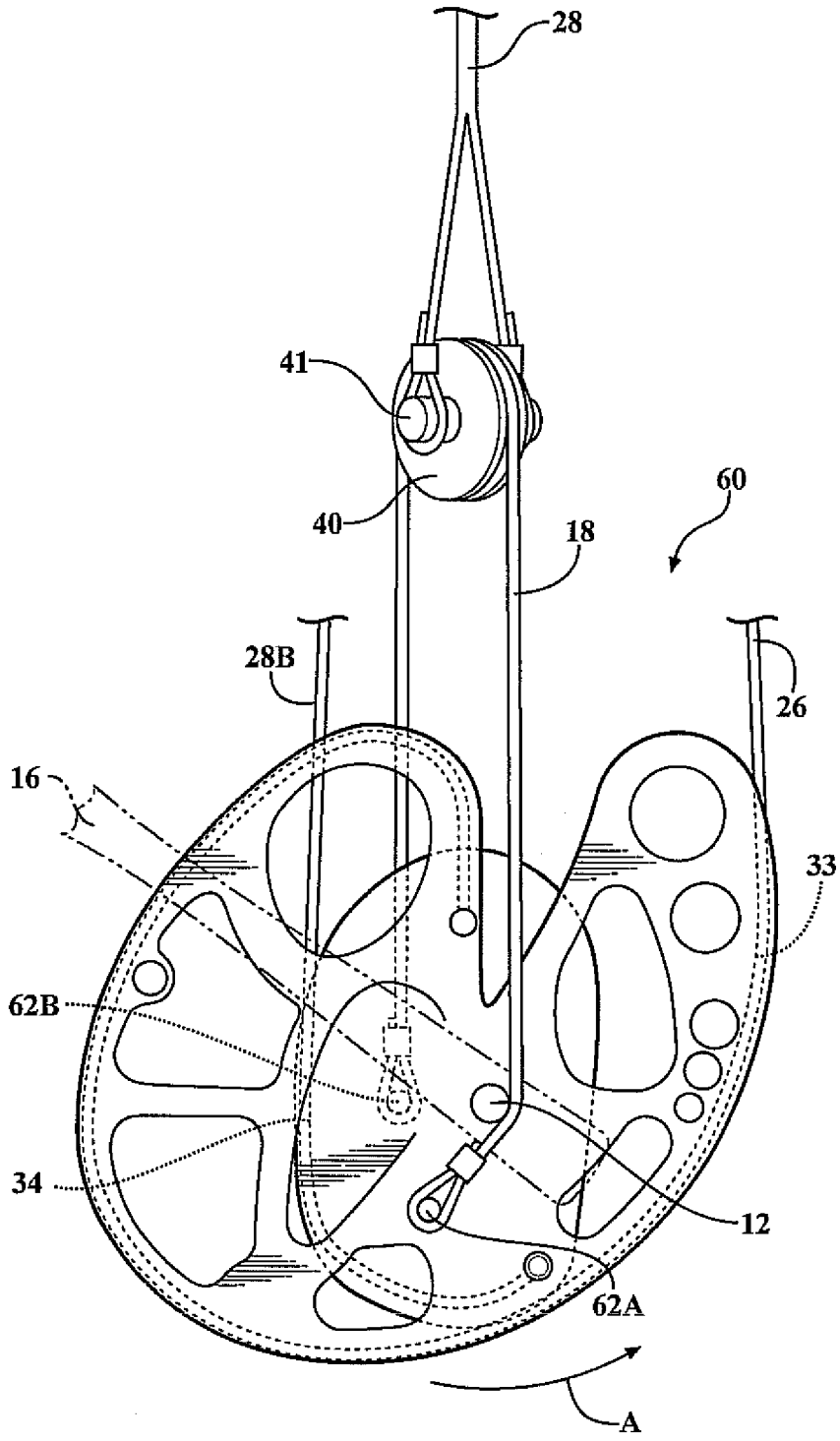
FIG. 8 is a side view showing a face of yet another embodiment of cam assembly in accord with the present invention.

Referring now to FIG. 8, there is shown yet another embodiment of cam assembly 60 in accord with the present invention. The cam assembly 60 of FIG. 8 is generally similar to the assembly shown in FIG. 1; however, instead of the controller including a spool as shown in FIG. 1, the controller function in this instance is accomplished by a pair of posts, one of which, 62*a*, is shown in solid outline and the other of which, 62*b*, is disposed on the opposite face of the assembly 60 and shown in phantom outline. As will be seen in FIG. 8, the post 62*a* engages one end of a control cable 18; and, as the cam 60 rotates as the string 26 is drawn, the post 62*a* is displaced in a counterclockwise direction and serves to unwind a portion of the length of the cable 18 from the axle 12 about which it is partially wrapped. Rotation will cause the second post 62*b* disposed on the opposite side of the cam to wrap and shorten the cable. In this manner, the effective length of the cable 18 will be varied as in the previous embodiments. Yet other variations of the FIG. 8 embodiment may be implemented. For example, both posts may be located on one face of the cam.

Figure 9:
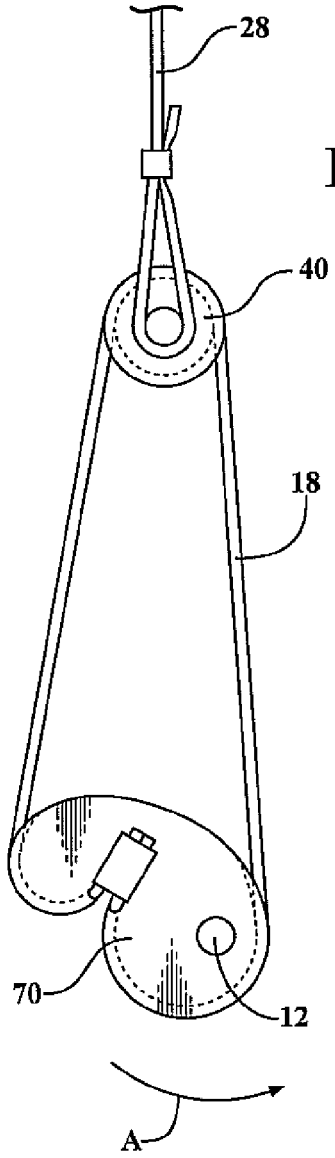
FIG. 9 is a depiction of another embodiment of controller which may be incorporated in the present invention.

Yet other embodiments of the present invention may be implemented. For example, while the embodiment of FIG. 1A and the embodiment of FIG. 5 show a controller which comprises a generally circular spool, it is to be understood that the controller may be otherwise configured. For example, FIG. 9 shows a controller 70 which has an irregular, curved shape. In use, the controller 70 of FIG. 9 is incorporated in a cam assembly generally similar to that of the foregoing figures. In that regard, the controller 70 is rotatable about a pivot axis 12 and engages a control cable 18 as previously described. As in the previous embodiments, the cable 18 engages a pulley 40 which is yoked to a portion of the bowstring 28. As will be apparent from the drawing of FIG. 9, rotation of the controller 70 will both take up and let out portions of the controller cable 18 at varying rates thereby accomplishing the aforedescribed control function.

Figure 10:
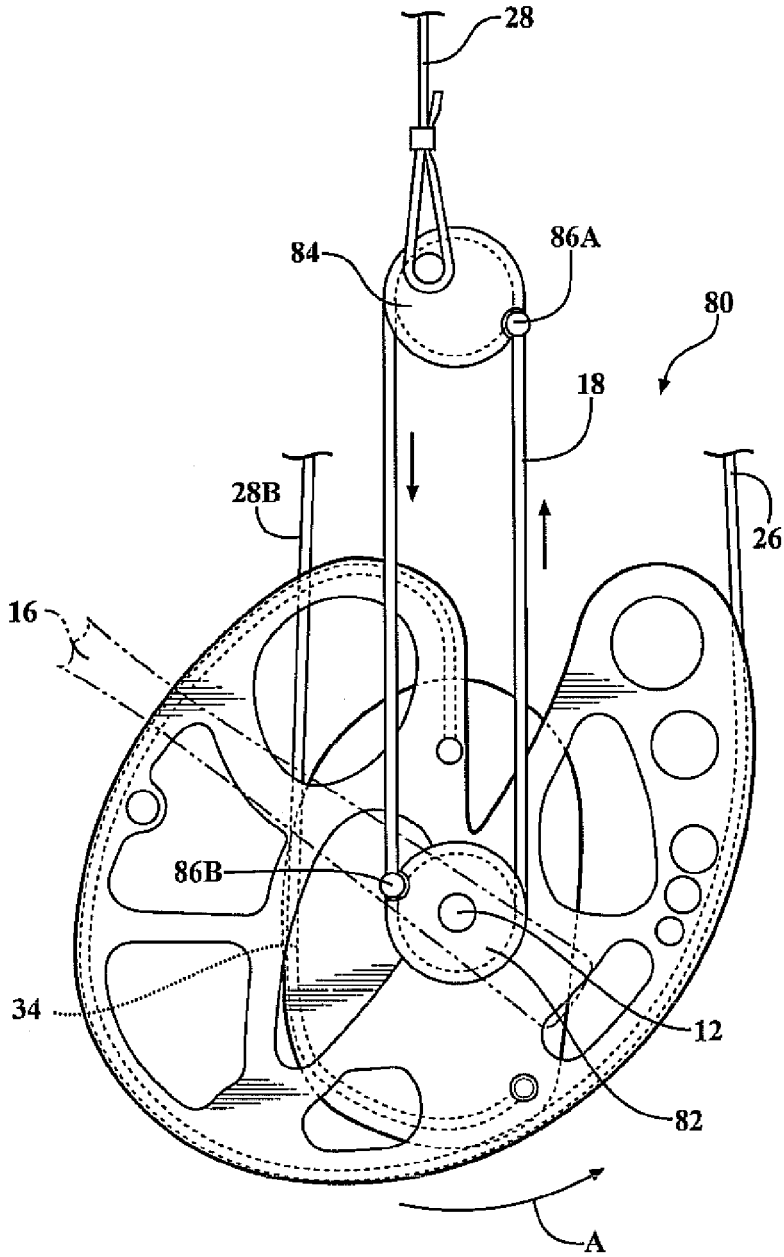
FIG. 10 is a side view showing a face of yet another embodiment of a cam assembly in accord with the present invention.
Figure 11:
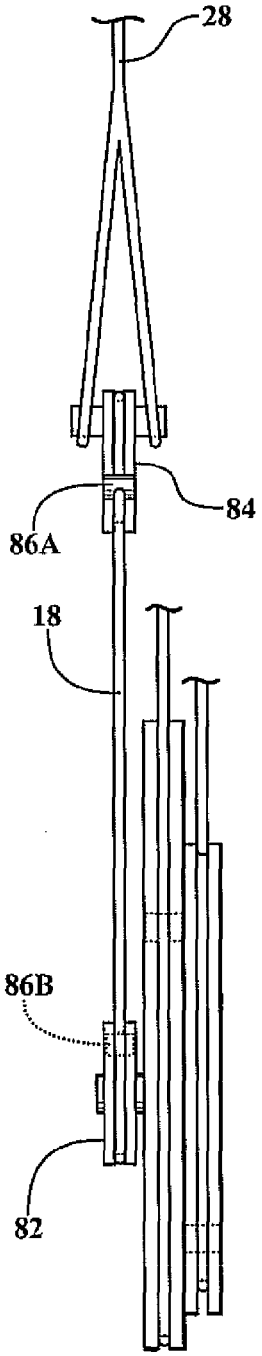
FIG. 11 is a front view of the controller of the cam assembly of FIG. 10.

As will be apparent from FIGS. 10 and 11, the present invention may be implemented in yet other embodiments. FIG. 10 is a side view of another embodiment of cam assembly 80 in accord with the present invention, and FIG. 11 is an end view of this embodiment. In the embodiment of FIGS. 10 and 11, the cam assembly 80 includes a spool 82, which in this embodiment is circular. The spool 82 engages a control cable 18 as previously described. In this embodiment, the cable 18 also engages an eccentric pulley 84 which further engages a portion of the bowstring 28 as in previous embodiments. This eccentric pulley 84 functions as a controller which changes the effective length of the portion of the string 28. As will be seen from FIG. 10, rotation of the cam assembly in the direction of arrow A rotates the controller cable 18, and the eccentric pulley 84 feeds out and takes up the cable 18 at varying rates producing the change in effective length. As will be seen in this embodiment, detent features 86*a*, 86*b* assure that the control cable 18 remains engaged with the spool 82 and pulley 84 so as to prevent slipping. In other embodiments, the cable 18 may comprise separate segments permanently affixed to the rotatable members.

It is to be understood that yet further modifications and variations of the aforedescribed assemblies may be implemented. For example, in the FIGS. 10 and 11 embodiment, the spool 82 may be eccentrically mounted and/or noncircular so as to provide additional control action of the control cable 18 and bowstring segment 28. Also, it is to be understood that various elements of the system of the present invention may be yet otherwise configured and/or positioned.

Figure 12:
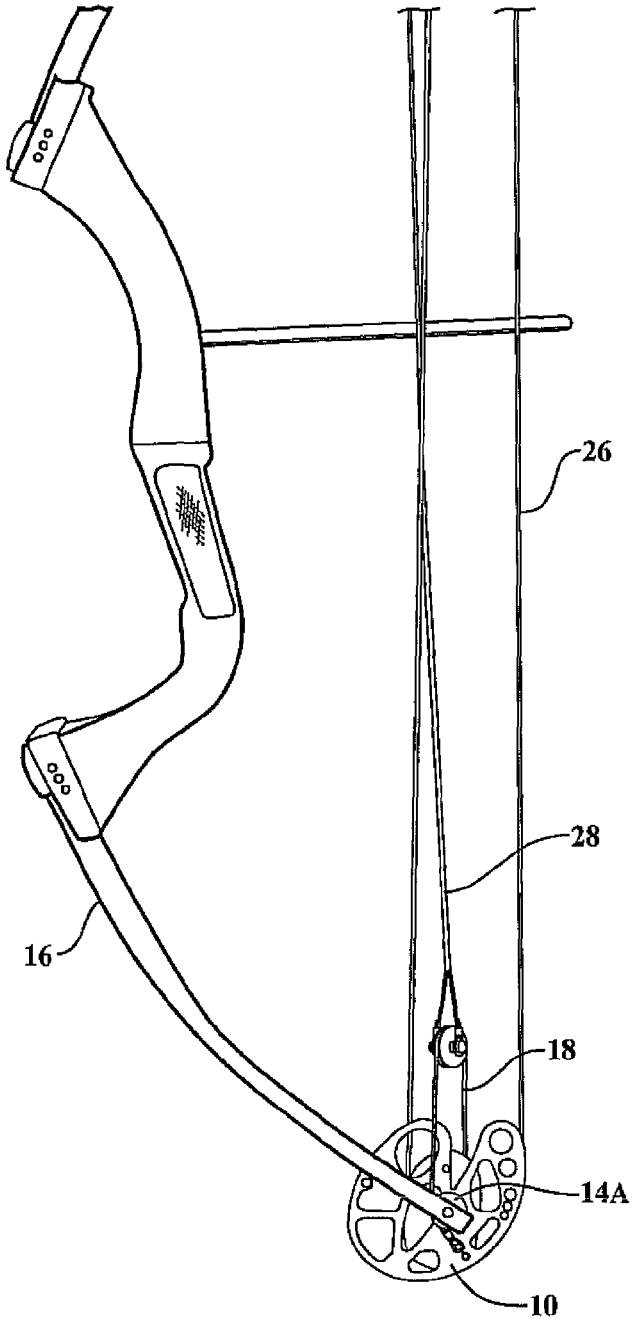
FIG. 12 is a drawing of a portion of an archery bow including a cam assembly generally similar to that of FIG. 1.

Referring now to FIG. 12, there is shown a portion of an archery bow having a cam assembly 10, generally similar to that of FIGS. 1A, 1B and 2 incorporated therein. In a two cam system, the top limb of the bow may include a corresponding cam. Alternatively, it may include a differently configured cam or, in single cam bow systems, may include an idler pulley assembly.

The foregoing illustrates some particular embodiments of the invention. Other modifications and variations thereof will be readily apparent to those of skill in the art in view of the teaching presented herein. The foregoing drawings, discussion and description are illustrative of some embodiments of the invention, but are not meant to be limitations upon the practice thereof. It is the following claims, including all equivalents, which define the scope of the invention.

The invention claimed is:

1. A cam assembly configured to be rotatably supported at a pivot axis on a limb of an archery bow, said cam assembly comprising:

a primary string feed-out configured and operative to feed out a length of a string as said bow is drawn; and a secondary string feed-out which is configured and operative so that when said bow is drawn and said primary string feed-out feeds out said length of said string, said secondary string feed-out, during an initial portion of the draw, takes up a portion of the length of said string and thereafter lets out a portion of the length of said string.

2. The cam assembly of claim 1, wherein said secondary string feed-out includes a control cable which is coupled to said string, and wherein said secondary string feed-out is configured and operative so that when said bow is drawn, the effective length of said control cable decreases during the initial portion of the draw and then increases whereby said secondary string feed-out initially takes up and then let outs a portion of the length of said string so as to change its effective length.

3. The cam assembly of claim 2, wherein said secondary string feed-out includes a cable controller which is operative, when said bow is drawn, to simultaneously shorten a first portion of the length of said control cable at a first rate and lengthen a second portion of the length of said control cable at a second rate wherein, during the initial portion of the draw, said first rate is greater than said second rate and thereafter said second rate is greater than said first rate.

4. The cam assembly of claim 3, wherein said controller includes at least one grooved spool.

5. The cam assembly of claim 4, wherein said controller includes two grooved spools.

6. The cam assembly of claim 5, wherein a first grooved spool is in mechanical engagement with a first end of said control cable and a second grooved spool is in mechanical engagement with a second end of said control cable.

7. The cam assembly of claim 4, wherein at least one of said at least one spool is circular.

8. The cam assembly of claim 4, wherein at least one of said at least one spool is noncircular.

9. The cam assembly of claim 4, wherein at least one of said at least one spool is eccentrically mounted relative to the axis of rotation of said cam assembly.

10. The cam assembly of claim 3, wherein said cable controller includes at least one post which engages said control cable.

11. The cam assembly of claim 2, wherein said control cable is mechanically coupled to said string via a pulley assembly or a yoke.

12. The cam assembly of claim 1, further including a string take-up which takes up a portion of the said string when the bow is drawn and the primary string feed-out feeds out said length of string.

13. An archery bow which includes a cam assembly in accord with claim 1.

14. A cam assembly configured to be rotatably supported upon a limb of an archery bow, said cam assembly comprising:

a primary string feed-out configured and operative to feed out a string as said bow is drawn; and a secondary string feed-out, the secondary string feed-out including a control cable and a cable controller, said cable controller being operative, when said string is being fed out from said primary string feed-out, to simultaneously shorten a first portion of the length of said control cable at a first rate and lengthen a second portion of the length of said control cable at a second rate which is different from said first rate, and wherein said control cable is mechanically coupled to said string so as to control the rate at which said string is let out and taken up by said secondary string feed as said bow is drawn.

* * * * *